US010758016B1

(12) United States Patent
Wang

(10) Patent No.: US 10,758,016 B1
(45) Date of Patent: Sep. 1, 2020

(54) ADJUSTABLE UMBRELLA CANOPY SHADE

(71) Applicant: Weigang Wang, El Monte, CA (US)

(72) Inventor: Weigang Wang, El Monte, CA (US)

( * ) Notice: Subject to any disclaimer, the term of this patent is extended or adjusted under 35 U.S.C. 154(b) by 0 days.

(21) Appl. No.: 16/691,982

(22) Filed: Nov. 22, 2019

(51) Int. Cl.
*A45B 25/08* (2006.01)
*A45B 25/14* (2006.01)
*A45B 23/00* (2006.01)

(52) U.S. Cl.
CPC ..... *A45B 25/08* (2013.01); *A45B 23/00* (2013.01); *A45B 25/14* (2013.01); *A45B 2023/005* (2013.01); *A45B 2023/0012* (2013.01); *A45B 2023/0031* (2013.01); *A45B 2023/0037* (2013.01)

(58) Field of Classification Search
CPC ..... A45B 25/08; A45B 25/14; A45B 23/00; A45B 2023/0031; A45B 23/005; A45B 2023/0012; A45B 2023/0037
USPC ..... 135/20.1, 20.3, 21, 39
See application file for complete search history.

(56) References Cited

U.S. PATENT DOCUMENTS 6,607,002 B2 * 8/2003 Reese ..... A45B 11/00 135/88.08
9,220,325 B2 * 12/2015 Ma ..... A45B 23/00
10,136,709 B2 11/2018 Ma
10,426,238 B2 10/2019 Huckvale
2002/0129847 A1 * 9/2002 Ma ..... A45B 23/00 135/98
2005/0028852 A1 * 2/2005 Reese ..... A45B 23/00 135/20.1
2005/0045217 A1 3/2005 Clarke
2006/0081277 A1 * 4/2006 Liu ..... A45B 23/00 135/20.1
2006/0254628 A1 * 11/2006 Tseng ..... A45B 23/00 135/20.1
2014/0166060 A1 * 6/2014 Ma ..... A45B 25/14 135/20.3
2015/0075574 A1 * 3/2015 Ma ..... A45B 25/08 135/20.1

FOREIGN PATENT DOCUMENTS

CN 202311632 U * 7/2012

OTHER PUBLICATIONS 4 page PDF Machine translation of CN 202311632-U. (Year: 2012).*

* cited by examiner

*Primary Examiner* — Robert Canfield
(74) *Attorney, Agent, or Firm* — Clement Cheng

(57) ABSTRACT

An adjustable umbrella canopy shade has a mounting post. The mounting post has a mounting post front side and a mounting post rear side. A cantilever support is mounted to the mounting post at a lower post hinge. A tension member is mounted to the mounting post at an upper post hinge. The tension member is mounted to the cantilever support at a cantilever support middle joint. A canopy is mounted to the cantilever support. A retainer system is mounted to the mounting post and coupled to the lower post hinge so that the retainer system moves with the lower post hinge. The lower post hinge is translationally mounted on the mounting post. A handle is formed on the retainer system, and the handle is mounted to a threaded handle shaft.

9 Claims, 4 Drawing Sheets

ADJUSTABLE UMBRELLA CANOPY SHADE

FIELD OF THE INVENTION

The present invention is in the field of umbrella canopy shades.

DISCUSSION OF RELATED ART

A variety of different umbrella canopy shades have been created for backyard use. Many canopy shades are cantilevered to avoid positioning a post directly underneath the shade.

For example, in China patent CN2686388Y entitled Covering-Expanding Umbrella by inventor Ma, published Mar. 23, 2005 the abstract discloses, "The utility model relates to the technical field of an umbrella, particularly a covering-expanding umbrella which integrates a covering and an umbrella into a whole. The utility model comprises a covering cloth, an umbrella seat and an umbrella column, wherein, the umbrella column is sheathed with a hand-pushing pipe which can slide upwards and downwards and can be positioned on the umbrella column. The right and left sides of the hand-pushing pipe are respectively pivoted with a telescopic support bar, the length of which is adjustable and a cross bar which is used for putting up the covering cloth is respectively fixed on the end part of each of the two support bars via connecting pieces; the top end of the umbrella column is provided with a connecting joint, a pivoting bridging beam is fixed on the connecting joint, and the bridging beam is provided with a winding mechanism which winds the covering cloth in the form of a cylinder shape; the covering cloth is wound on the mechanism, and both the ends of the covering cloth are connected with the corresponding cross bar. The utility model can adjust the angle of the umbrella face at both sides according to need, can get different models and sun-shading angles and can wind the covering cloth into cylinder shape, and thus, trivial details of binding can be removed."

Also for example, in the China patent CN201001460Y entitled Simple Banana Suspending Umbrella by inventor Liu, published Jan. 9, 2008 the abstract discloses, "The utility model relates to a sunshade, in particular to a simple and easy banana suspended umbrella, which is mainly composed of an umbrella rod, a suspension rod, a pull rod, an umbrella surface and an umbrella rack, wherein the bottom end of the pull rod and the top of the umbrella rod are connected; the top of the pull rod is connected with the suspension rod; the top of the umbrella and the bottom of the pull rod are of the horizontal and rotational connected structure; the umbrella rod is provided with sliding sleeve of the locking device matching the umbrella rod; the sliding sleeve comprises a rope coiling device and is connected with the bottom end of the suspending rod; the top end of the suspending rod and the umbrella plate on the umbrella rack are of the pitching rotational connected structure; one end of the pull strong is connected with the rolling shaft of the rope coiling device and the other end has a suspending rod; and the top pipe arranged in the upper umbrella plate is connected with the lower umbrella plate. The structure in the utility model makes the umbrella surface convenient to open and close; thereby the umbrella surface can not only rotate around the umbrella rod for 360 degree, but also adjust the pitching angle. The umbrella surface is stable and the operation is simple, labor-saving and convenient."

Also for example, in the China patent number CN201079087Y entitled Sun-Shading Suspended Umbrella by inventor Wu, published Jul. 2, 2008 the abstract discloses, "The utility model relates to an adumbral hanging umbrella, which is characterized in that the utility model comprises an umbrella stand (6), an umbrella cover (9) which is covered on the umbrella stand and is used for the adumbral function, an upright post (2), a retaining mechanism (7) which can adjust the upward view angle of the umbrella cover an is arranged at the middle part of the upright post and a hollow hanging arm (3). One end of the hanging arm is connected with the retaining mechanism (7), and the other end is connected with the umbrella stand (6). The hanging arm (3) is provided with a hand-operated steering mechanism (4) which controls the opening-closing of the umbrella stand (6) and the deflexion of the umbrella stand (6) closed to the retaining mechanism (7). A standing rope (8) is arranged in the hanging arm (3) with one end being connected on the hand-operated steering mechanism (4) and the other end being fixed on the umbrella stand. The utility model is also provided with a connecting rod (5) with one end being rotatablely connected with the upper end part of the upright post (2) and the other end being rotatablely connected on a hanging arm hinge (31) arranged at the middle part of the hanging arm (3). Compared with the prior art, the utility model has the advantages that the adumbral hanging umbrella not only can be folded, but also can adjust the direction with simple and convenient operation and multiple functions."

For example, in the International patent number CN 201691212U Sun Umbrella With Adjustable Umbrella Cover by inventor Liu, published Jan. 5, 2011 the abstract discloses, "The utility model discloses a sun umbrella with an adjustable umbrella cover, which comprises an upright rod and an umbrella frame. A handrail capable of sliding up and down is sleeved on the upright rod and pivotally connected with the bottom end of an oblique rod, the top end of the oblique rod is connected with the umbrella frame via a pitching rotary connecting structure, the top end of the upright rod is connected with one end of a pull rod, the other end of the pull rod is movably connected with the oblique rod, and an angle adjusting device is arranged at the connection of the handrail with the oblique rod and provided with a locking device. The sun umbrella with an adjustable umbrella cover allows the umbrella cover to incline left and right, and the umbrella cover can be optionally positioned when being opened, can simultaneously tilt back and forth, and lead the sunshade umbrella to achieve sunshade effect in all dimensions, thereby promoting use values of the sunshade umbrella. The sun umbrella with an adjustable umbrella cover has the advantages of simple structure, convenient operation and beautiful appearance."

For example, in the International patent number CN 203369482U Sunshade Umbrella by inventor Luo, published Jan. 1, 2014 the abstract discloses, "A sunshade umbrella is characterized in that a rotary mechanism used for connecting a bent arm is arranged at the top of a vertical pillar, the bent arm is arranged on the vertical pillar through the rotary mechanism, the lower end of the bent arm is fixedly connected with a crank outer shell, the vertical pillar is sleeved with a check ring, a vertical pillar positioning block and a pull handle sequentially from top to bottom, the check ring is fixedly arranged on the vertical pillar in a sleeved mode, the pull handle can be arranged on the vertical pillar in a vertical sliding limiting mode, the vertical pillar positioning block can be installed on the check ring in a rotary mode and achieves rotary positioning by being matched with the pull handle, a U-shaped installation base is arranged at a side of the vertical pillar positioning block, and an umbrella surface regulating mechanism is arranged on the installation base and connected with the crank outer shell through an inclined rod. The umbrella surface regulating mechanism and an umbrella surface rotary mechanism are integrated in the same assembly, the structure is easier, and cost is lowered. In addition, the operation is simple, the sunshade angle can be regulated in a section-free mode, the sunshade position can be regulated at 360 degrees, and the sunshade umbrella can be matched with an asymmetrical umbrella surface, so that the appearance is novel and unique."

For example, in the International patent number CN 203435821U Umbrella Fabric Dip Angle Adjusting And Positioning Mechanism Of Hanging Umbrella by inventor Shan, published Feb. 19, 2014 the abstract discloses, "The utility model provides an umbrella fabric dip angle adjusting and positioning mechanism of a hanging umbrella, and belongs to the technical field of human life necessities. The umbrella fabric dip angle adjusting and positioning mechanism of the hanging umbrella solves the problem that after the umbrella fabric dip angle adjusting and positioning mechanism of an existing hanging umbrella is used for a long time, a sliding sleeve cannot be positioned to a stand column, so that the hanging umbrella cannot be used normally. The umbrella fabric dip angle adjusting and positioning mechanism comprises a stand column, an umbrella frame and a diagonal rod, one end of the diagonal rod is hinged to the umbrella frame, the umbrella fabric dip angle adjusting and positioning mechanism is arranged between the diagonal rod and the stand column, and comprises a pushing handle, a positioning piece and a positioning screw, a sliding groove is formed in the stand column, the sliding groove is arranged in the length direction of the stand column, the pushing handle is embedded in the sliding groove and can slide along the sliding groove, the other end of the diagonal rod is hinged to the pushing handle, the positioning piece and the pushing handle are fixedly connected and are arranged in the sliding groove, the positioning screw passes through the pushing handle and abuts against the positioning piece, and the positioning screw enables the positioning piece to abut against the bottom face of the sliding groove. The umbrella fabric dip angle adjusting and positioning mechanism of the hanging umbrella has the advantages of being long in service life, convenient to operate, and capable of saving effort."

For example, in the International patent number CN 201602243U An Adjustable Angle Umbrellas by inventor Wu, published Oct. 13, 2010 the abstract discloses, "An adjustable angle umbrellas, including umbrella stand, and canopy column, umbrella frame comprising a long rib, short rib, rib plate length, short rib plate, upper strut and the lower strut, the long rib One end of the long rib around the rotatable disc is provided, around the end of the short rib short rib disposed rotatable disc, and the other end of the rotary type provided inside the rib and the corresponding length can be relatively folded away, the long end of the umbrella struts the bone plate and the other end of the short rib plate through the upper hinge and the lower strut, the strut on top of the central column via a connecting member rotatably connected at a range of angles of formula, the central pillar is provided with a relatively uprights can slide up and down the locking mechanism, the locking mechanism is hinged at one end with the lower end of the strut. Compared with the prior art, the present invention is advantageous in that: the umbrella frame is in the open state, as long as slide up and down by the locking mechanism, the angular adjustment can be achieved quickly, quick operation, the overall configuration is relatively simple and easy assembly."

For example, in the U.S. Pat. No. 10,136,709 Cantilever Umbrella buy Oliver Joen-An Ma, published Nov. 27, 2018 the abstract discloses, "A cantilever umbrella assembly is provided that includes an upright pole, a runner, a transverse pole, and a canopy. The upright pole includes an upright guide surface. The runner is coupled with the upright pole and has a bearing coupled with the guide surface for guiding the runner along the upright pole. The cantilever umbrella assembly includes a deployable tension member with a first end disposed in the transverse pole and a second end coupled with the canopy."

For example, in the U.S. Pat. No. 10,426,236 Multi-Function Double-Canopy Umbrella by Derrick Huckvale, published Oct. 1, 2019 the abstract discloses, "A multi-function double-canopy umbrella comprises: a first foot, a second foot, a mounting plate bolted to the first and second feet, a lower post attached to the mounting plate, an upper post, an inner core inserted into the lower and upper posts, a central tube, a spool, a crank rotatably attached to the spool, a rope threaded through the central tube, central ribs, central arms pivotably attached to the central ribs, an adjustable central canopy attached to the central ribs to adjust to different heights, an intersector slidably attached to the central tube, first ribs pivotably connected to the intersector and central arms, second ribs, multi-rib-connecting cores slidably connected to the first and second ribs to adjust the multi-function double-canopy umbrella to multiple different sizes, raising arms foldably attached to the intersector, an adjustable ring canopy attached to the first and second ribs, and adjusting flaps sewn to the adjustable ring canopy to adjust it to multiple different sizes."

For example, in the United States patent publication number 20050045217 Height Adjustable Umbrella Assembly by Dougan Clarke, published Mar. 3, 2005 the abstract discloses, "This invention relates to an umbrella assembly and a framing assembly associated therewith which includes a stanchion assembly having a variable longitudinal dimension dependant on whether the umbrella is in a collapsed position or an expanded position. An adjustment assembly interconnects separable, first and second portions of the stanchion assembly exerts a biasing force on the second portion, and the canopy supporting ribs attached thereto. The biasing forces the second portion outwardly from the first portion as the umbrella assumes a collapsed position. The ribs, and canopy are thereby raised a greater than normal distance from a supporting surface of the umbrella and interference between the plurality of ribs and any object disposed at the base of the umbrella is prevented, when in the collapsed position." The discussed references above are incorporated herein by reference.

SUMMARY OF THE INVENTION

An adjustable umbrella canopy shade has a mounting post. The mounting post has a mounting post front side and a mounting post rear side. A cantilever support is mounted to the mounting post at a lower post hinge. A tension member is mounted to the mounting post at an upper post hinge. The tension member is mounted to the cantilever support at a cantilever support middle joint. A canopy is mounted to the cantilever support. A retainer system is mounted to the mounting post and coupled to the lower post hinge so that the retainer system moves with the lower post hinge. The lower post hinge is translationally mounted on the mounting post. A handle is formed on the retainer system, and the handle is mounted to a threaded handle shaft.

Optionally, the adjustable umbrella canopy shade has a handle mounted to a handle shaft. The handle is formed as a knob. The adjustable umbrella canopy shade is formed as a cantilevered umbrella. The cantilevered umbrella has rib supports supporting ribs at rib support joints. The ribs are hinged at an upper joint. A central support is hinged to the ribs at the upper joint, and hinged to the rib supports at a lower joint so that the central support is vertically oriented. The handle shaft retainer retains the handle shaft. The handle is mounted on the mounting post front side. The handle shaft retainer is coupled to the lower post hinge.

The retainer system further includes a right guide member and a left guide member. The right guide member fits into a right guide channel, and a left guide member fits into a left guide channel. The right guide member is mounted on a right guide arm, and the left guide member is mounted on a left guide arm. The stopper is mounted to the handle shaft.

A central tube is formed within the mounting post. The stopper is configured to tighten when the handle shaft thread rotates to press the stopper against a stopper contact face. The stopper contact face is formed on the central tube. A rear chamber is formed adjacent to the central tube in the mounting post. Preferably, the adjustable umbrella canopy shade also includes a left chamber and a right chamber formed adjacent to the central tube in the mounting post. A handle shaft stopper frame made of a rigid material can retain a handle shaft stopper. T the right guide member and the left guide member engage the right guide channel and the left guide channel when the handle shaft stopper engages the stopper contact face. Preferably, the right guide channel and the left guide channel are angled toward each other at a right post flange and a left post flange. The right post flange is angled toward the left post flange to form a funnel shape so that the right guide member and the left guide member are biased toward each other when the stopper is engaged to the stopper contact face.

The following call out list of elements can be a useful guide in referencing the element numbers of the drawings.

20 Canopy
21 Rib
22 Rib Support
23 Rib Support Joint
24 Upper Joint
25 Lower Joint
26 Central Support
27 Cantilever Support
28 Cantilever Support Middle Joint
29 Tension Member
30 Mounting Post
31 Mounting Post Base
32 Upper Post Hinge
33 Lower Post Hinge
34 Lower Post Hinge Bracket
35 Lower Post Hinge Joint
36 Mounting Post Rail
37 Mounting Post Front Side
38 Mounting Post Rear Side
39 Mounting Post Left Side
40 Retainer System
41 Knob Handle
42 Handle Grip
43 Handle Shaft
44 Handle Shaft Retainer
45 Handle Shaft Carriage
46 Handle Shaft Thread
47 Handle Shaft Stopper Frame
48 Handle Shaft Stopper
49 Central Tube
50 Post Cross Extrusion
51 Rear Chamber
52 Right Chamber
53 Left Chamber
54 Right Guide Channel
55 Left Guide Channel
56 Right Guide Member
57 Left Guide Member
58 Right Guide Arm
59 Left Guide Arm
60 Post Exterior Surface
61 Right Post Flange
62 Left Post Flange
63 Flange Opening
64 Stopper Frame Retaining Member
65 Stopper Contact Face
66 Central Tube Outside Surface
67 Stopper Inside Face
68 Handle Shaft Swivel

DETAILED DESCRIPTION OF THE PREFERRED EMBODIMENT

Figure 1:
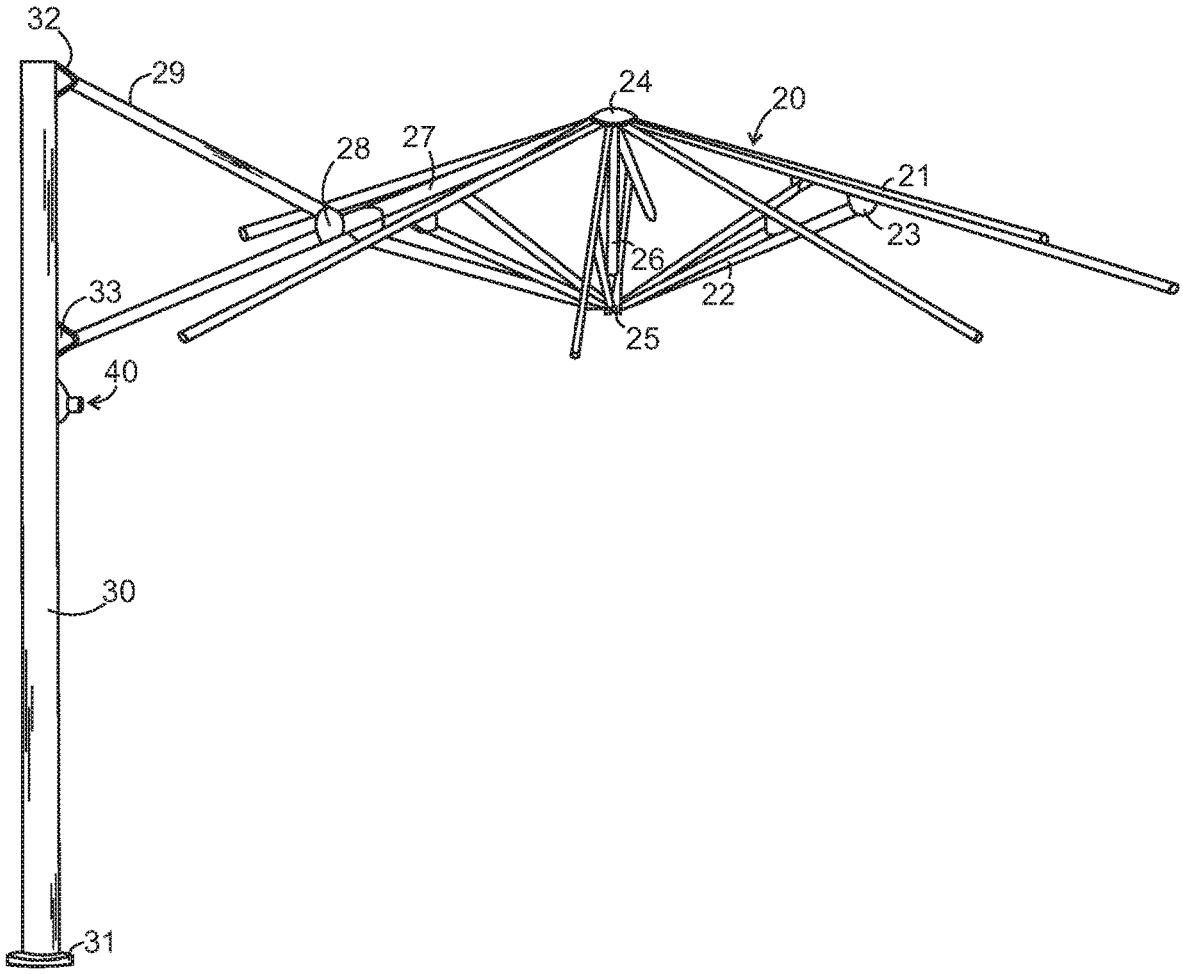
FIG. 1 is a side view of the cantilevered umbrella canopy shade.

As seen in FIG. 1, a canopy 20 can be formed in the shape of an umbrella. The canopy has a number of ribs 21. Each rib 21 is supported by a rib support 22 and each rib support connects to each rib 21 at a rib support joint 23.

A central support 26 can be formed as a short post that defines a triangle between the rib support 22 and the rib 21. The rib support 22 is pivotally hinged to the central support 26 at a lower joint 25 in the same way that the rib support 22 is pivotally hinged to the rib 21 at the rib support joint 23. The ribs 21 are hinged to each other radially at an upper joint 24 as well as to the central support 26. The central support 26 has an upper joint 24 connecting to the ribs 21 and a lower joint 25 connecting to the rib supports 22.

One of the ribs 21 forms a cantilever support 27 that is connected to and extends away from the upper joint 24. The cantilever support 27 is hinged to a tension member 29 at a cantilever support middle joint 28. The tension member is hinged to an upper post hinge 32 mounting post 30 and the cantilever support is hinged to a lower post hinge 33. The upper post hinge 32 is mounted above the lower post hinge 33 on the mounting post 30. The mounting post 30 may be connected to a mounting post base 31 such as a flange for installation.

Figure 2:
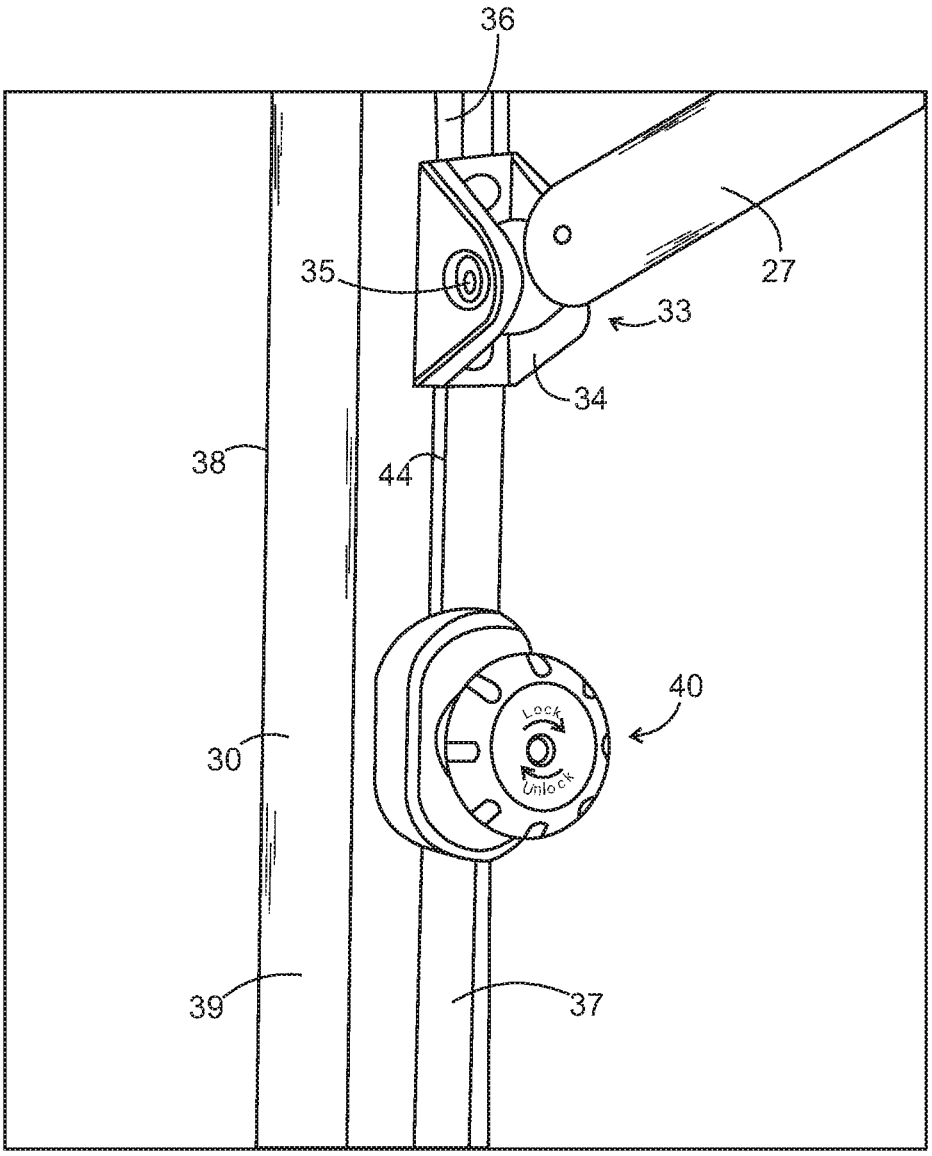
FIG. 2 is an external view of the retainer system.

As seen in FIG. 2, the cantilever support 27 pivots on a lower post hinge 33 and the lower post hinge 33 includes a lower post hinge bracket 34 having a lower post hinge joint 35. The lower post hinge bracket 34 is formed with a pair of extending flanges from a bracket base that is mounted to the mounting post 30. The lower post hinge 33 is height adjustable because the lower post hinge bracket 34 is mounted to a vertically oriented mounting post rail 36. The mounting post rail 36 has a mounting post front side 37, a mounting post rear side 38, and a mounting post left side 39. The retainer system 40 is preferably rigidly connected to the lower post hinge bracket 34. A handle shaft retainer 44 of the retainer system 40 extends upwardly and may be connected to the lower post hinge bracket 34 so that the retainer system 40 and the lower post hinge bracket 34 slide with each other.

Figure 3:
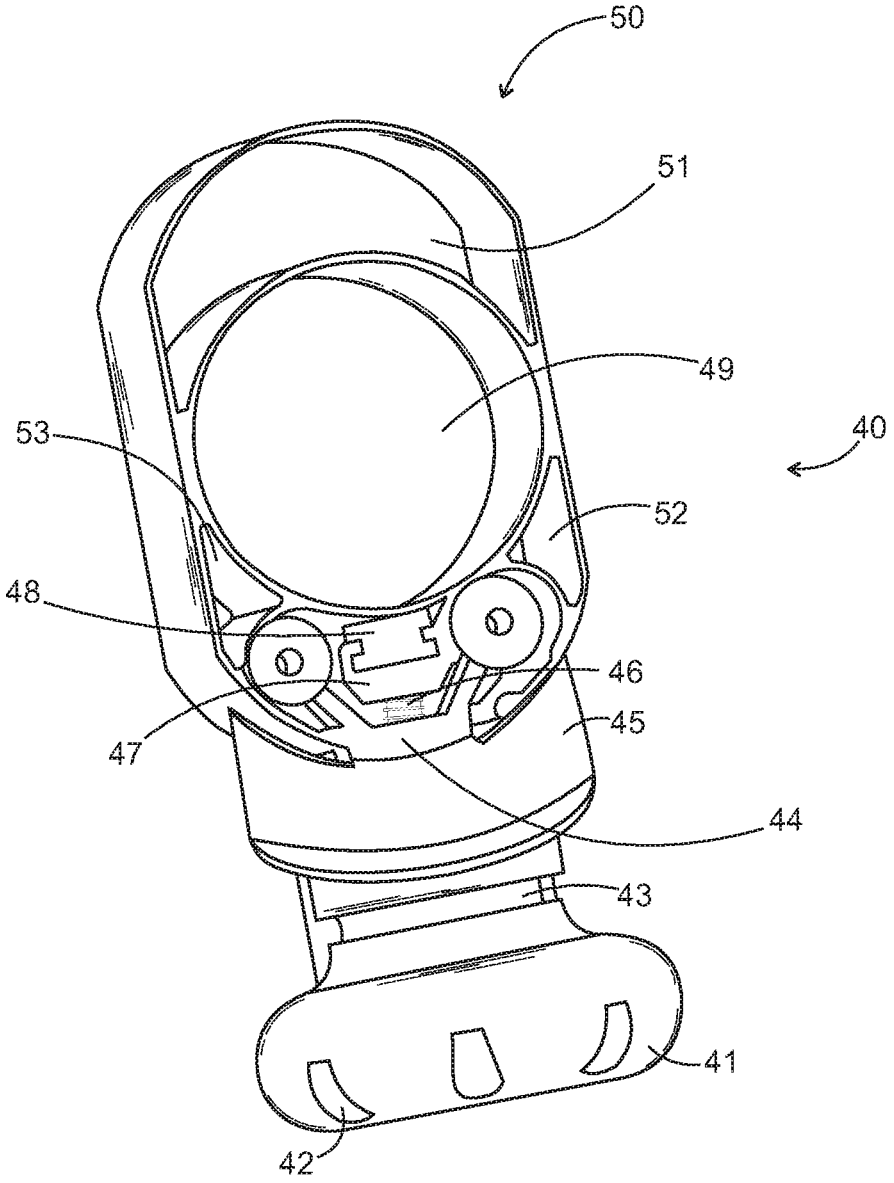
FIG. 3 is a top cross-section view of the retainer system.

As seen FIG. 3, a retainer system 40 seen in cross-section view has a post cross-section extrusion 50, showing a central tube 49, a rear chamber 51 behind the central tube 49, and a right chamber 52, as well as a left chamber 53. The left right, front rear orientation is from the relative position of the umbrella portion of the canopy, where a user might sit.

The central tube is preferably cylindrical and extending the length of the post. The retainer system 40 mounts to the post 30. The retainer system 40 has a knob handle 41 with handle grip 42 that connects to a handle shaft 43. The handle shaft 43 protrudes when a user rotates the knob handle 41. The handle shaft 43 is mounted to a handle shaft retainer 44 which acts as a frame. The handle shaft retainer 44 extends upwardly to the lower post hinge bracket 34.

A handle shaft carriage 45 fits over the handle shaft retainer 44. The handle shaft carriage has a pair of extending ends, including a right end and a left end that extend to the right and left of the slot formed in the mounting post rail 36. The handle shaft has handle shaft thread 46 which is threadedly secured to the handle shaft retainer 44. The handle shaft thread 46 also continues to a handle shaft stopper frame 47 that retains a handle shaft stopper 48. The handle shaft stopper frame 47 can be made of aluminum and the handle shaft stopper is preferably elastomeric.

Figure 4:
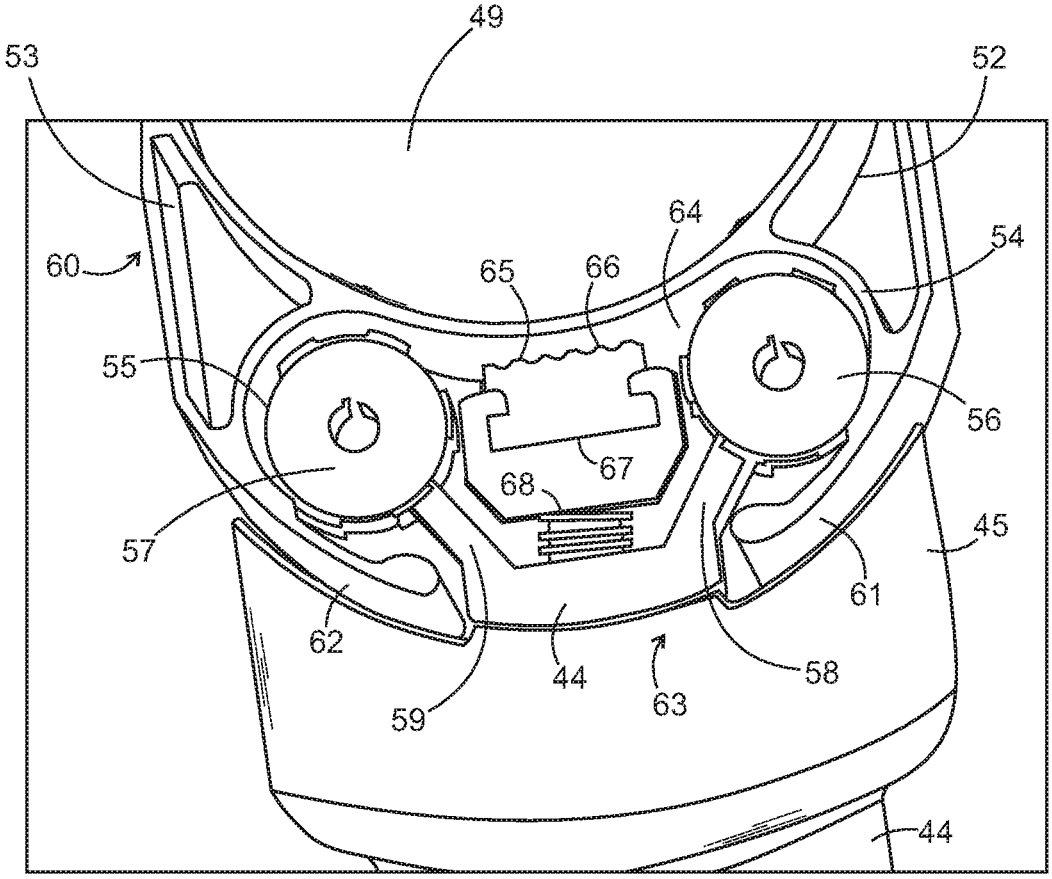
FIG. 4 is a close-up view of the cross-section view of the retainer system.

As seen in FIG. 4, the slot is formed as a flange opening 63 which is defined between a right post flange 61 and a left post flange 62. Behind each post flange is a guide channel. A right guide channel 54 is formed between the right chamber 52 and the right post flange 61. A left guide channel 55 is formed between the left chamber 53 and the left post flange 62. The handle shaft retainer 44 branches with a right guide arm 58 extending to the right chamber 52 and a left guide arm 59 extending to the left chamber 53. A handle shaft carriage 45 covers the slot and handle shaft retainer 44. A right guide member 56 is mounted to the right guide arm, and the left guide member 57 is mounted to the left guide arm.

The retainer system 40 engages to the central tube 49 as a user turns the knob handle 41. Turning the knob handle 41 locks a stopper contact face 65 to a central tube outside surface 66. When a user engages the knob, the stopper engages the central tube and the stopper inside face 67 presses against the stopper frame retaining member 64. The stopper contact face 65 can be flat or may have grooves that engage the central tube. As the stopper contact face 65 pushes against the central tube, the stopper contact face may deform due to its elastomeric nature. A post exterior surface 60 faces the handle shaft carriage 45.

Additionally, an optional handle shaft swivel 68 can allow the stopper contact face 65 to stay at a particular orientation to the central tube outside face 66. When the stopper contact face 65 abuts the central tube outside face 66, a ridge and groove grip surface can improve friction.

The guide arms are preferably slightly flexible so that the Y shaped prong configuration allows the right guide member and the left guide member to engage with the right guide channel 54 and the left guide channel 55. The guide members, namely the right guide member and the left guide member can be made as cylinders with elastomeric grippy surfaces. The guide member grip surfaces can be mounted on wheels shaped as spools with a spool axle so that the grip surfaces rotate when the stopper contact face engages with the central tube outside surface 66. Thus, the extending compression force of the stopper against the stopper contact face 65 causes the guide members, namely the right guide member and the left guide member to engage the guide channels and such engagement can be improved if the guide arms are slightly flexible and can be formed as cantilevered leaf springs. The guide arms can engage the underside of the right post flange 61 and the left post flange 62 which are angled so that the pair of guide members has a wedge engagement to the pair of post flanges. The wedge engagement is activated when the handle knob is turned to engage the grip surface of the stopper and the guide members.

The invention claimed is:

1. An adjustable umbrella canopy shade comprising:

a. a mounting post, wherein the mounting post has a mounting post front side and a mounting post rear side;

b. a cantilever support mounted to the mounting post at a lower post hinge;

c. a tension member mounted to the mounting post at an upper post hinge, wherein the tension member is mounted to the cantilever support at a cantilever support middle joint;

d. a canopy mounted to the cantilever support;

e. a retainer system mounted to the mounting post and coupled to the lower post hinge so that the retainer system moves with the lower post hinge, wherein the lower post hinge is translationally mounted on the mounting post;

f. a handle formed on the retainer system, wherein the handle is mounted to a handle shaft, wherein the handle shaft is threaded;

g. a handle shaft retainer, wherein the handle shaft retainer retains the handle shaft, wherein the handle is mounted on the mounting post front side, wherein the handle shaft retainer is coupled to the lower post hinge, wherein the retainer system further includes a right guide member and a left guide member, wherein the right guide member fits into a right guide channel, and wherein a left guide member fits into a left guide channel, wherein the right guide member is mounted on a right guide arm, and wherein the left guide member is mounted on a left guide arm, wherein a stopper is mounted to the handle shaft; and a central tube formed within the mounting post, wherein the stopper is configured to tighten when the handle shaft thread rotates to press the stopper against a stopper contact face, wherein the stopper contact face is formed on the central tube.

2. The adjustable umbrella canopy shade of claim 1, further comprising a rear chamber formed adjacent to the central tube in the mounting post.

3. The adjustable umbrella canopy shade of claim 1, further comprising a left chamber and a right chamber formed adjacent to the central tube in the mounting post.

4. The adjustable umbrella canopy shade of claim 1, further comprising a handle shaft stopper frame made of aluminum holding a handle shaft stopper.

5. The adjustable umbrella canopy shade of claim 1, wherein the right guide member and the left guide member engage the right guide channel and the left guide channel when the handle shaft stopper engages the stopper contact face.

6. The adjustable umbrella canopy shade of claim 5, wherein the handle is mounted to a handle shaft, wherein the handle is formed as a knob.

7. The adjustable umbrella canopy shade of claim 5, wherein the canopy is formed as a cantilevered umbrella.

8. The adjustable umbrella canopy shade of claim 5, wherein a cantilevered umbrella has rib supports supporting ribs at rib support joints; wherein the ribs are hinged at an upper joint;

wherein the cantilevered umbrella further includes a central support hinged to the ribs at the upper joint, and hinged to the rib supports at a lower joint, wherein the central support is vertically oriented.

9. The adjustable umbrella canopy shade of claim 5, wherein the right guide channel and the left guide channel are angled toward each other at a right post flange and a left post flange, wherein the right post flange is angled toward the left post flange to form a funnel shape so that the right guide member and the left guide member are biased toward each other when the stopper is engaged to the stopper contact face.

* * * * *